340-566 SR
10/7/80 OR 4,227,188

United States Patent [19]

Petersen

[11] 4,227,188

[45] Oct. 7, 1980

[54] INTRUSION ALARM CONTROL SYSTEM

[76] Inventor: Christian C. Petersen, 206 Conant Rd., Westwood, Mass. 02090

[21] Appl. No.: 945,643

[22] Filed: Sep. 25, 1978

Related U.S. Application Data

[60] Division of Ser. No. 750,667, Dec., 1976, Pat. No. 4,122,437, which is a continuation-in-part of Ser. No. 554,717, Mar., 1975, Pat. No. 4,012,611.

[51] Int. Cl.[2] ..... G08B 13/08

[52] U.S. Cl. ..... 340/566; 340/528; 340/546; 340/384 E

[58] Field of Search ..... 390/546, 566, 545, 528, 390/384 E

[56] References Cited

U.S. PATENT DOCUMENTS

| | | | |
|---|---|---|---|
| 3,803,576 | 4/1974 | Dobrzanski et al. | 340/528 |
| 3,905,016 | 9/1975 | Peterson | 340/384 E |
| 4,122,437 | 10/1978 | Peterson | 340/528 |

*Primary Examiner*—III Swann

*Attorney, Agent, or Firm*—Gerald L. Smith

[57] ABSTRACT

An intrusion alarm system utilizes an inertially responsive sensor preferably present as a pendulum actuated reed switch. Logic circuits provided within the system provide, an efficient pulsating alarm at dual frequencies optimized for human recognition. In both arrangements, a unique dual delay arrangement is provided, one delay commencing with the arming of the device to permit adequate time for the setting of a sensing switch. A second delay arrangement is provided at the option of the operator for purposes of delaying the activation of the alarm once the sensor switch has been tripped. This feature may be utilized to permit entrance through a door or the like upon which the unit is mounted wherein the device can be deactivated prior to assuming an alarm sounding condition. One embodiment provides for achieving a "beat" form of loudspeaker drive through the use of a first oscillator which is modulated by a network including an R-C timing circuit coupled with a trigger exhibiting a hysteresis triggering characteristic.

9 Claims, 4 Drawing Figures

INTRUSION ALARM CONTROL SYSTEM

RELATED APPLICATIONS

The present invention is continuation-in-part of application for U.S. Pat., Ser. No. 750,667 filed Dec. 15, 1976, now U.S. Pat. No. 4,122,437 which, in turn, is a continuation in part, of application for U.S. Pat., Ser. No. 554,717, filed Mar. 3, 1975, now U.S. Pat. No. 4,012,611.

BACKGROUND

Intrusion alarm systems have been devised under a broad number of schemes ranging from a dog that barks to ultra sophisticated systems designed for the protection of highly valuable property and produced at commensurate cost. When developing any of the intrusion alarm systems, the design approach generally is premised upon a need to apprise one entity of the passage and, preferably, attempted passage of another entity across a selected portal or vulnerable boundary.

The effectiveness of alarm designs has, to the present, been predicated upon the degree of sophistication, redundancy and/or number of separate components for the system contemplated. As alarm system designs have evolved for broadened, higher volume markets, their sophistication has given way to the extent that the sensing techniques utilized tend toward either the primitive or specialized-monofunctional and the logic of alarm control is reduced to affording the operator only few alternatives, i.e., the devices are more readily compromised. For instance, instrusion alarm devices intended for the relatively higher volume, popularly priced market have been seen to utilize simple switches mounted on the inside of a door to detect a successful unauthorized entry. Such sensing does not enjoy the capability for detecting and alerting to an attempted entry. For such a function, sensing components must be capable of exhibiting a very high degree of sensitivity to minor impact or similarly generated phenomena. Where an alarm is sounded at a mere attempted entry, the occupant within the area of alert is afforded the most valuable of surveillance service—the maximum available time interval to react to undertake protective measures.

To remain practical for higher volume markets, all such sensing devices should be easily calibrated to accommodate for an obviously broad range of sensing conditions. For instance, environmental "noise" conditions such as vibration and the like must be easily accounted for.

To simplify gaining access through a door protected by a simplified alarm, resort often is made to designs permitting an alarm delay following the triggering thereof. Thus the operator may enter an alarm supervised door and, within the delay interval, disarm the alarm by throwing an arm switch or the like. To be effective in this form, the delay period must be relatively short and the resetting technique should be relatively difficult to ascertain by anyone but the operator.

Coded entrance arrangements heretofore have been proposed wherein a switching code or key system is mounted at the outer side of a protected door and which, when properly actuated, remotely disarm an alarm system. Such systems, however, generally are too complex for manufacture and installation under high volume procedures suited to achieve popular price levels. For instance, the devices may be required to be mounted and wired within a wall. Alternately, complexities are encountered in protecting otherwise exposed wiring extending from one side of a door to another.

Another aspect to be considered in providing a practical alarm system suited for popular utilization resides in the degree of installation expertise required of the purchaser. A most advantageous system is one which requires no mounting or assembly expertise whatsoever; for instance, no wiring or sensor switch installation, and equally simple access accessory installation.

SUMMARY

The present invention is addressed to a unique intrusion alarm sensing arrangement and system. Suited for a broad range of applications within the popularly priced market, the alarm system, including power supply, sensor, alarm and logic circuitry conveniently may be incorporated within a relatively small, lightweight singular housing readily mounted upon a door or portal selected for surveillance.

The sensor of the system responds inertially to an impact or motion generating phenomena imparted to the housing and is adjustable to exhibit a sensitivity which, for many installations, will react to a mere attempt at unauthorized entry. In its preferred embodyment, the sensor is formed including a body of predetermined mass suspended in pendulum-like fashion upon a rod or the like from a fixed point within the housing. However, other mounting arrangements for the mass are contemplated within the scope of the invention. A switch arrangement including a magnetically actuable switch and a magnet is mounted with respect to the end portion of the rod and a fixed, null location upon the housing. Any relative movement between these components will trip the system to sound an alarm. Preferably, a bar-type permanent magnet is fixed to the rod terminus, while a magnetically actuated reed relay switch is fixed to the housing.

Through the use of a switch arrangement incorporating a reed relay switch, a region of higher ferrous metal mass derived from overlapping switch contacts is provided on the housing toward which region the pendulum suspended magnet will automatically tend to null. This feature provides for convenient arming procedures and operation.

Another feature and object of the invention is to provide an alarm system including first and second oscillator networks, the first of which provides an output signal at a first frequency selected for optimum lower frequency human recognition. The second oscillator network provides an output at a second higher frequency, again selected for optimum human recognition. Activation of the second network serves to drive an alarm-transducer device at the second frequency and is dependent upon the derivation of a signal from the sensor as well as the presence of a select output condition of the first oscillator network. Accordingly, a pulsating "on and off" alarm is sounded at optimized first and second frequencies. With the system, the sensor signal need only be transient.

As another feature, the system provides a delay arrangement which responds to the actuation of a system arm or enable switch. This feature provides an initial delay to permit the sensor to attain a null after arming, as well as providing a period during which a person may exit through a protected entry without sounding the alarm.

Another feature and object of the invention is to provide an alarm system providing not only the above-noted delay arrangement responding to the actuation of the enable or alarm switch to permit stabilization of the sensor, but also a timing arrangement wherein the alarm will not sound for a given short interval following the activation of the sensor. Should the reset switch of the system be actuated within that interval, the entire system will reset itself. Such system also provides for an operator selection for inserting such alarm delay or for providing operation wherein the alarm is activated simultaneously with the actuation of the sensor. Such an arrangement facilitates the use of the device wherein remote disarm arrangements are not available and reset access to the system must be had through the portal upon which the alarm system is mounted.

As another feature and object, the system of the invention provides a pulsating output for a loudspeaker which has been excited at an optimum audible frequency through unique resort to the hysteresis characteristic of a trigger device operating in conjunction with an R-C timing network. Thus, a pulsating output is achieved with the system at improved manufacturing economies.

Other objects of the invention will in part be obvious and will in part appear hereinafter.

The invention, accordingly, comprises the system and apparatus possessing the construction, combination of elements and arrangement of parts which are exemplified in the following detailed disclosure.

For a fuller understanding of the nature and objects of the invention, reference should be had to the following detailed description taken in conjunction with the accompanying drawings.

DETAILED DESCRIPTION

The basic unit of the intrusion alarm system of the invention is housed in a small, compactly structured container so dimensioned as to be conveniently attached to a portal intended for surveillance, i.e., a door, window or the like. This unit contains an inertially reactive sensing device, logic circuitry, alarm and power supply.

Figure 1:
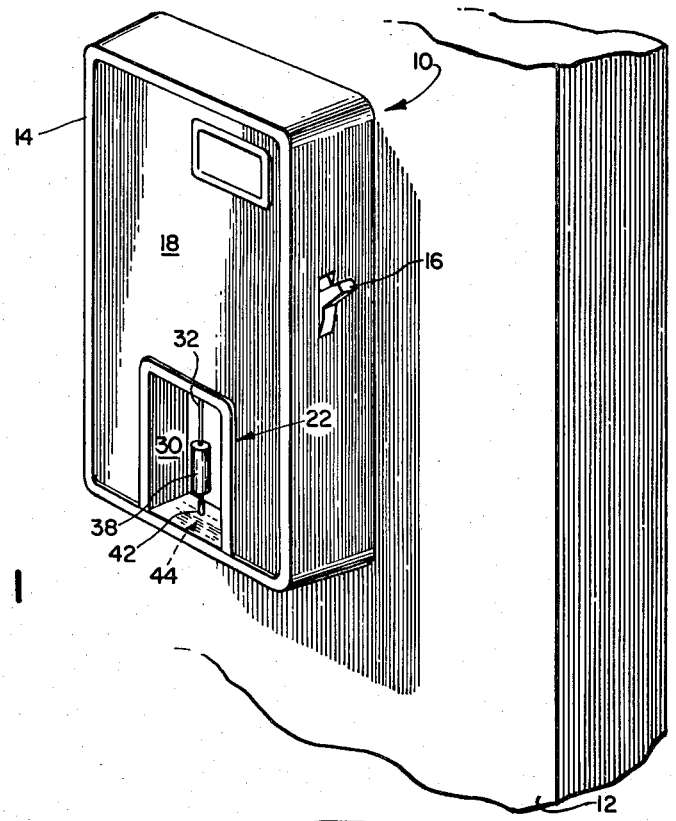
FIG. 1 is a perspective view of the basic alarm system unit of the invention as it is mounted upon a door.

Looking to FIG. 1, the basic intrusion alarm unit is revealed generally at 10 as it may be mounted, for example, upon a door 12. Unit 10 includes a box-like outer container 14, the rearward face of which is secured to an interior surface of door 12. Inasmuch as unit 10 may be fabricated of very light but sturdy materials, i.e., plastic, attachment to the door 12 may be conveniently provided by such materials as dual adhesively faced tape or the like positioned intermediate the rear surface of the unit and the door surface. In addition to integrated logic and alarm circuitry and, preferably, a typical primary battery power supply, container 14 supports an arm switch 16, a loudspeaker, for the embodiment of FIG. 3, located within the unit for broadcast through surface area 18 thereof, and an inertially responsive sensor assembly, respresented at 22. In general, the basic alarm 10 performs as follows: Upon positioning unit 10 at a location for detecting vibration, impact, accellerative motion or the like, for instance, upon the inside face of door 12, the operator throws arm or enable switch 16, which serves to activate an alarm-logic circuit only following a predetermined interval, for instance, 30 seconds. That arming interval permits any motion imparted to appropriate components of sensor assembly 22 during the arming procedure to be damped so as to gain a quiescent, null condition without tripping the alarm. This interval also will permit the operator to leave the area under surveillance through the door 12 upon which the unit 10 is mounted without causing it to prematurely trip. A slight motion or impact imparted to unit 10 from door 12 subsequent to the arming interval will activate the sensing system of the device to sound a loud pulsating alarm. In all the embodiments, after having been set off, the pulsating alarm can be turned off only following a predetermined interval, for instance, 50 seconds, from the throwing of arm or enable switch 16 to its initial off or disarm orientation. Should the sensing arrangement of the device not have been tripped, so throwing switch 16 to an off orientation will immediately deactivate the system.

The self-contained sensing arrangement 22 of the alarm system enjoys a particularly advantageous feature. For instance, through its inertially based performance, it is able to sense a very light impulse, thus being capable, in many instances, of forewarning the user thereof of a mere attempt at unauthorized entry. As a consequence, a highly valuable interval for protective reaction is availed the user. This feature is available, while, importantly, the sensitivity of the assembly 22 remains adjustable to accommodate for spurious vibration or motion, i.e. "noise", which otherwise might occasion false alarms. Another important aspect of the sensor assembly 22 resides in its incorporation within unit 10, i.e., small, compact unit 10 is an entirely self-contained alarm system with no externally positioned components.

Figure 2:
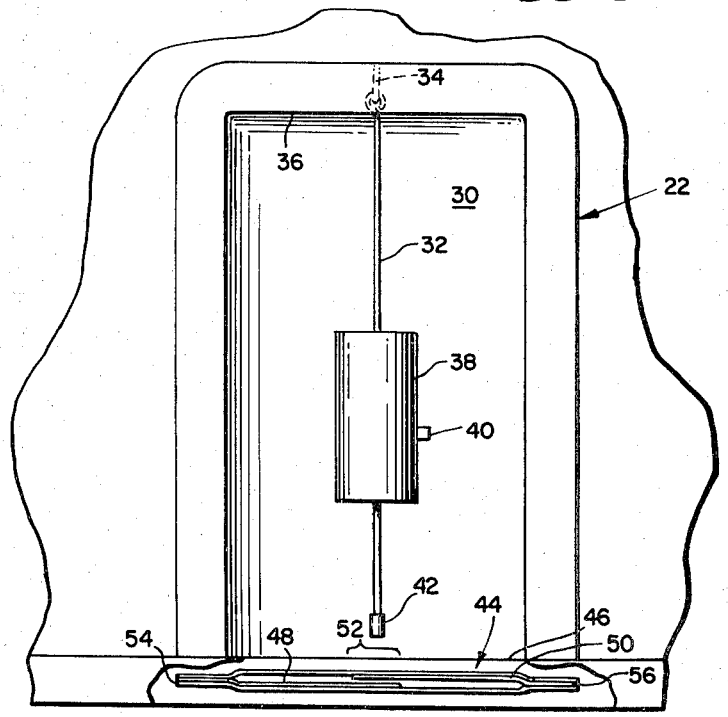
FIG. 2 is a fragmentary front view of the sensor arrangment of the invention.

Looking to FIG. 2, sensor assembly 22 is revealed in more detail as it is oriented in a null or quiescent status. The assembly is formed within a compartment or the like 30 of container 14 and includes a rod or suitable support 32 which is pivotally suspended therein. In this regard, the upper end of rod 32 is formed as a hook or the like and provides freely swinging pivotal attachment with a U-shaped connector 34 fixed within top wall 36 of compartment 30. Slideably mounted upon rod 32 is a body of predetermined mass present as a centrally bored cylinder 38 fashioned of any suitable stock material, for instance, aluminum, brass, or the like. Cylinder shaped mass 38 is radially bored and tapped to receive a set screw 40 which may be tightened against rod 32. With this arrangement, mass 38 may be positioned at any desired location along rod 32 and the assembly, thus far described, may be observed to represent a pendulum.

To the opposite, lower end of rod 32 is attached a small, somewhat cylindrically shaped, vertically oriented bar type permanent magnet 42. Magnet 42, thus suspended for movement in conjunction with rod 32, is located such that its lower polar end is situated a given, relatively slight distance above a conventional magnetic reed switch 44. Switches as at 44 typically include a sealed tubular glass envelope 46 supporting therewithin, in cantilever fashion, two oppositely disposed, parallel and mutually spaced metal switch contacts as at 48 and 50. Present as low reluctance, ferromagnetic, slender flattened reeds, these contacts are oriented to overlap in spaced mutual relationship defining a small air gap at a centrally disposed region 52 of switch 44. Accordingly, when caused to close or join, contacts 48 and 50 complete an electrical circuit through leads as at 54 and 56. Closure is carried out by causing contacts 48 and 50 to assume opposed magnetic polar states, i.e., north and south. In the presence of sufficient flux density, the attraction forces of the opposing magnetic poles overcome the reed stiffness causing them to flex toward each other to make contact.

As may be evidenced from the drawing, contacts 48 and 50 uniquely are separated to define an open circuit when vertical magnet 42 is oriented, as shown, directly over region 52. This mutual identically polarized condition of the contacts providing for their open circuit orientation is occasioned by the relatively close proximity of only one, the lower, pole of magnet 42 to the ferrous metal mass represented by those end or overlapping portions of the contacts within region 52. In the presence of an actuating impulse or movement, the orientation of magnet 42 with respect to switch region 52 is altered to a position outwardly disposed from region 52. Here, the magnetic flux influence upon switch 44 alters to establish opposing magnetic poles at the respective end portions of contact 48 and 50 within region 52. As a consequence, the switch rapidly reacts to close.

In general, the above-described actuating alteration of the open contact conndition of switch 44 is occasioned by a relative motion of the switch itself with respect to magnet 42. This relative movement results from an inertial tendency of the body of mass 38, and, consequently, magnet 42 to remain at rest while impulse generated motion is imparted to switch 44. Note in this regard, that switch 44 is fixed with respect to compartment 30 which, in turn, is fixed within container 14, fixedly attached, in turn, to door 12 (FIG. 1). Of course, following the above-detailed rapid initial switch actuation, rod 32 will tend to swing, thereby causing subsequent additional switch actuations. As is described in detail hereinafter, the initial actuation of switch 44 will cause the setting off of an alarm.

The sensitivity of the sensor arrangement shown is advantageously and simply adjustable by the operator. For example, a lower sensitivity may be provided by raising cylindrical mass 38 upon rod 32. Conversely, higher degrees of sensitivity are effected by simply lowering mass 38 to a selected position closer to magnet 42. Such adjustments may be provided, for instance, to accommodate the alarm device to function properly in the presence of environmental vibrations or the like which otherwise might occasion false alarms.

In addition to a uniquely responsive alarm switching or tripping function being provided by the above-described inertial sensing arrangement, an important, additional operational function is achieved. The overlapping portions of contacts 48 and 50 at region 52 constitute a region of relatively higher ferrous metal mass. Accordingly, vertically oriented magnet 42 is continually biased to orient itself over that region, in effect, a null point being developed thereat. Once the rod 32-magnet 42 assembly is disturbed to assume a swinging motion, it will tend to self-null at region 52. In consequence of this nulling reaction, sensor 44 will reset itself within an advantageously shorter interval and impart a valuable stability to the sensing system. As a further advantage, the entire basic unit 10 may be mounted upon a door 12 or the like with greater ease. The requisite null orientation of the rod 32-magnet 42 assembly will be effected without recourse to elaborate alignment procedures during the mounting of unit 10. For instance, a minor misalignment on the part of the operator is acceptable due to the attraction between the lower pole of magnet 42 and the ferrous metal mass at region 52.

The inertial sensing arrangment of the invention may assume a variety of configurations, however, that preferred has been described above in connection with FIGS. 1–2. As an example of another configuration, rod 32 may be formed of a resilient material, i.e., piano wire or the like, and fixedly mounted to a wall of the unit housing in cantilever fashion. As in the preferred embodyment, a permanent bar magnet would be attached to the free end of such rod so as to be juxtaposed to a region as at 52 of a reed or suitable magnetically actuated switch. Additionally, such switch may be mounted upon the rod 32 or the like, while the magnet is fixed to the unit housing.

Figure 3:
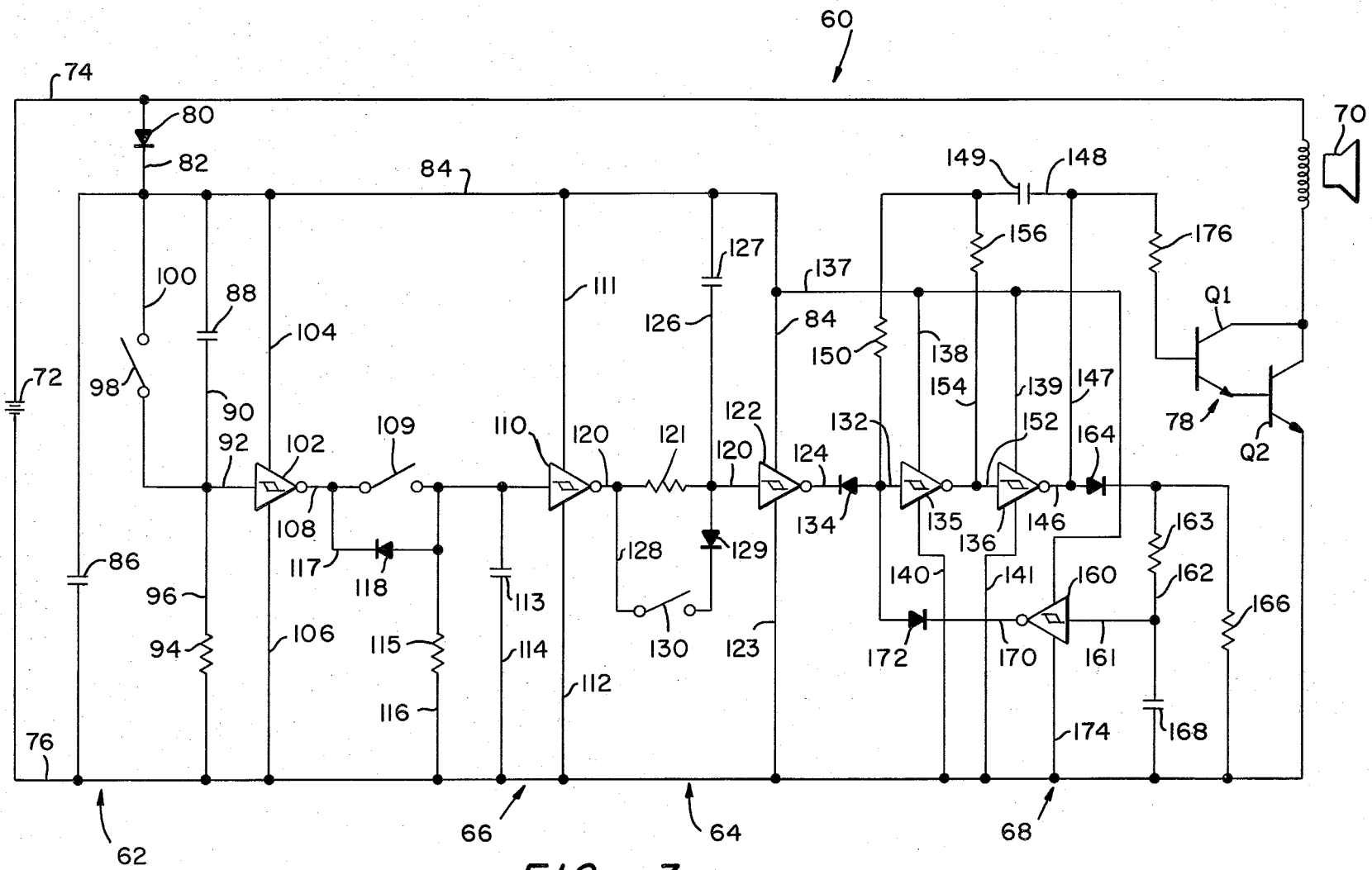
FIG. 3 is a schematic drawing of the logic circuit of one embodiment of the invention.

Turning to FIG. 3, a circuit intended for incorporation within unit 10 and operable in complement with sensor assembly 22 is revealed. This circuit is suited for applications wherein the sensing and alarm system is utilized in homes, apartments and the like wherein an optional alarm delay feature as well as alarm state termination features are desired. Circuit 60 generally includes a first or initial timing or delay circuit 62; two additional timing networks 64 and 66; a modulated oscillator network 68; and a P.M. loudspeaker 70. The logic components of circuit 60 are Schmitt triggers which are derived from a hex monolithic complementary MOS (CMOS) integrated circuit constructed with N- and P-channel enchancement transistors. As will be discussed in detail later herein, the descrete triggers thereof are selected having a hysteresis characteristic, for example as provided by model MM74C14 marketed by National Semiconductor Corp., Santa Clara, Calif. Such logic components exhibit very little power drain when the circuit is in a quiescent state, thereby contributing one facet to the high efficiency of the circuit of the system. For purposes of facilitating the description to follow, when the inputs or outputs of identified components are at a ground or appropriately pass a corresponding reference potential, they are referred to as "low" and, additionally, such input or output may be digitally identified as "0". Conversely, when these inputs or outputs assume or approach the voltage status of the power supply, they are referred to as being "high" and are given the binary designation "1".

Power may be supplied to the circuit 60 from a battery 72 which may be of a typically locally available 9 volt variety. The positive terminal of battery 72 is coupled through line 74 to PM loudspeaker 70 while the opposite pole thereof is coupled through line 76 to Darlington coupled transistors $Q_1$ and $Q_2$ of a driver arrangement 78. Connection of the logic components of the circuit from line 74 is provided through diode 80 present within line 82 and from line 76. Line 82 is coupled to a logic power line 84. A capacitor 86 is connected intermediate lines 84 and 76 and this capacitor, operating in conjunction with diode 80 provides a filtered power level input for the logic components. Additionally, diode 80 protects the logic components from an inadvertent assertion of a reverse voltage. For consumer related devices, it may anticipated as a facet of product design that battery 72 may inadvertently be connected within the circuit with an improper reversed polar orientation.

Circuit 60 incorporates an initial timing or delay circuit 62 which serves the function of permitting the sensor 22 to achieve a null state and also for permitting the user to, for instance, leave through the door upon which the device is mounted. This circuit 62 includes a capacitor 88 positioned within line 90 which, in turn, extends between line 84 and input line 92, as well as a timing resistor 94 positioned within line 96 between line 92 and line 76. The arm switch in the instant embodiment is shown at 98 positioned within a line 100 and coupled in shunt relationship across capacitor 88 between lines 84 and 92. Thus, while switch 98 is closed, i.e. "off", capacitor 88 is discharged and the logic level at line 92 is "1". Accordingly, with the opening of switch 98, timing circuit 62 is activated to commence a voltage charge at line 92 toward a "0" level, which signal is monitored at the input of inverter trigger or gate 102, one of the six logic components of the above-described Hex Schmitt trigger. Power input to trigger or gate 102 is supplied from line 84 through lead 104 and from line 76 through lead 106. The trigger or gate exhibits a negative going threshold voltage characteristic such that upon the occurrence of a lower level voltage value at its input line 92 (i.e. about 3.2 volts with respect to a 9 volt supply at batery 72), the output thereof at line 108 converts from a "0" to a "1" level. The resistance and capacitance values at circuit 62 are such as to effect the conversion at gate 102 following about a thirty-second delay from the opening switch 98. The "1" signal level at line 108 represents an arm condition signal.

Line 108 incorporates the inertially responsive sensor switch 22 earlier described as including reed switch 44 and now represented as switch 109. From the opposite side of switch 109, line 108 is directed to the input of another inverter-Schmitt trigger 110 powered from lines 84 and 76, respectively, through lines 111 and 112. Coupled between lines 108 and 76 intermediate switch 109 and the input to trigger 110 is timing network 66 including capacitor 113 coupled within line 114. Note additionally, the presence of a resistor 115 connected within line 116. A line 117 incorporating diode 118 connects from line 116 across switch 109 to line 108 as it extends from the output of gate 102.

With the arrangement shown, assuming that sensor switch 109 has been actuated to close, the arm condition signal or "1" level is conveyed from the output of trigger 102 across switch 109 to the input of gate 110. Assuming that switch 109 is closed only instantaneously, such interval is adequate to rapidly charge capacitor 113 to a high state, the only limitation to the rate of such charge being the low resistance of trigger 102 itself. Normally, capacitor 113 will charge in less than a millisecond. The "1" level thus developed at the input to gate 110, representing a conveyed arm condition signal, converts the normal "0" level thereat to a "1" value, to cause, in turn, the conversion of the output of gate 110 at line 120 from a "1" to a "0" value. Note that the "0" value normally retained at the input of gate 110 is held through resistor 115 in line 116.

The output line 120 of gate 110 extends through resistor 121 to the input of gate 122. Inverter gate or trigger 122 is connected directly to line 84 and to line 76 through line 123 and provides an output at line 124.

Extending intermediate resistor 121 and the input to gate 122 between lines 120 and 84 is a line 126 incorporating a timing capacitor 127. Also formed within control network 64 is a line 128 extending from the output of gate 110 at line 120 across resistor 121 to communicate with line 126. Line 128 incorporates a blocking diode 129 as well as a switch 130. Providing an alarm delay function, switch 130, when closed, serves to effect an instantaneous response of the alarm system to the closure of sensor switch 109. Alternately, when switch 130 is open, the system provides about a ten-second delay between the closure of sensor switch 109 and the sounding of an alarm at loudspeaker 70.

Looking in more detail at the functions of timing networks 64 and 66 and assuming an arm condition signal at the output of gate 102, a single transient closure of sensor switch 109 results in timing capacitor 113 charging immediately to a "1" state as was noted previously. In the absence of any additional sensor signals, timing capacitor 113 will proceed to discharge through lines 114, 108, 116 and resistor 115 to again achieve a "0" value after a predetermined amount of time, i.e., about 40 seconds. This timing function will be seen to be utilized in connection with a control over the length of time loudspeaker 70 continues to be activated following the closure of sensor switch 109. Any additional sensor closures during that period of time will result in a recharging of capacitor 113 and the "adding on" of 40 seconds more to the presence of a "1" signal at the input to gate 110, that is, assuming that the arm condition signal is still present at the output of gate 102. With the assertion of a conveyed arm condition signal of "1" value at the input to gate 110, the resultant signal value at its output at line 120 is "0". However, prior to the derivation of a "0" value at line 120, that line is at a "1" value, that value being present at the input of gate 122. Additionally, capacitor 127 is discharged at a high level. The corresponding value at output line 124 is a "0" which will be observed to hold oscillator circuit 68 in an inactive condition. Assuming the closure of switch 130, and the presence of a low value at the output line 120 of gate 110, the "1" value at capacitor 127 immediately is charged towards a "0" value through line 126 and 128 and diode 129 to ground through gate 110 and line 112. The resultant instantaneous "0" value at the input to gate 122 is converted to a "1" level at its output line 124 to effect an activation of oscillator circuit 68, and, in consequence, the sounding of an audibly perceptible alarm at P.M. loudspeaker 70.

Thus being charged to achieve a "0" signal level, capacitor 127 then maintains that level until the input of gate 110 reverts to a "0" level as was described previously. The presence of a "0" at the input to gate 110 results in a "1" output at line 120 and at that time capacitor 127 will proceed to discharge through lines 126, 120, 111 and resistor 121 to gradually reassume a "1" level. This discharge period will be about equal to the alarm delay period since it incorporates the same components and is selected to be about ten seconds. At the termination of this total interval (the discharging of capacitors 113 and 127), a "1" level is reasserted at the input of inverter gate 122 as at line 120 to convert its output at line 124 to a "0" level. In consequence, the oscillator circuit 68 is deactivated to, in turn, deactivate P.M. loudspeaker 70. As will be noted from the foregoing description, the alarm, after being triggered, will sound for a period of time of at least 50 seconds, (40 seconds from network 66 and 10 seconds from network 64) and will then shut down automatically. This feature is a valuable asset for the condition where a single false signal may be received setting off the alarm with no one present in the home. Since it will shut itself off it will not result in generating extreme aggravation with the "neighbors" or wearing out of the battery when such spurious signals are received. Of course, if additional alarm signals are received, then the alarm will continue to sound for 50 seconds after the last received signal.

Should the operator of the system desire to provide, for instance, a ten-second delay in the activation of loudspeaker 70 following the tripping or closing of sensor switch 109, switch 130 is set in the open position. Such an arrangement, for example, permits reaccess through the door upon which the unit is mounted and disarming within that ten-second interval, thereby permitting its use without the incorporation of an alarm disabling device mounted externally of the door. With this alarm condition the above-mentioned 50-second period is reduced by the alarm delay period to 40 seconds for a single spurious alarm signal. Assuming that sensor switch 109 has been closed under the above condition, a conveyed arm condition signal is present at the input of gate 110. The resultant "0" level at its output at line 120 does not effect an immediate charge of capacitor 127 to, in turn, immediately cause the assertion of a "0" signal level at the input to gate 122. Under the noted delay condition, capacitor 127 now is required to charge through resistor 121 and gate 110 through line 112 to ground. The time constant for these components is arranged, for example, to require about ten seconds to provide for the development of a "0" level signal at the input to gate 122. At the termination of such interval, gate 122 inverts the input "0" level signal thereat to a "1" value at its output line 124 to commence activation of the loudspeaker 70.

Assuming this feature is being used to enter the door upon which the unit is mounted, within the noted ten-second delay interval, the operator closes switch 98 to effect the shunting of capacitor 88, and, in turn, impose a "1" level at input line 92 of gate 102. The output of gate 102 reverts to a "0" level at line 108. This "0" level at line 108 causes the immediate discharge of capacitor 113 through lines 114, 108, 117, diode 118, gate 102 and line 106 to ground. A "0" input signal level thereby is presented at the input to gate 110 which is converted to a "1" level at its output at line 120. As a consequence, capacitor 127 is prevented from any further charge to ground and the "1" level is retained at the input to gate 122 to maintain a "0" signal level at its output line 124 and inactivation of oscillator circuit 68. No alarm activation ensues.

Diode 129 serves a particular function under situations wherein with switch 130 closed and switch 98 is closed after an alarm condition has been established with the tripping of switch 109 and the activation of loudspeaker 70. With the noted closure of switch 98, the output of gate 110 rapidly converts from a "0" to a "1" level. Capacitor 127 will be at some charge level below a "1" level effecting the continued "1" (alarm) level output of gate 122 at line 124 diode 129 preventing its immediate dicharge through switch 130. This alarm condition will continue, capacitor 127 having to be discharged through resistor 121 to effect a continuance of the alarm signal until such time as a "1" value signal level is achieved at the input to gate 122. This therefor, makes it impossible, once loudspeaker 70 has been activated, to immediately "shut down" the alarm with the closure of switch 98 and guarantees the sounding of loudspeaker 70 for some predetermined minimum interval. It may also be noted that diode 118 serves the function of assuring the appropriate discharge of capacitor 113 upon the closing of switch 98, even though sensor switch 109 may be opened or alternately opened and closed during this deactivation procedure. Normally, the system will continue to sound an alarm from loudspeaker 70 following the initial activation thereof until both timing networks 64 and 66 discharge to the appropriate "0" level for network 66 at the input of gate 110 and then, serially, the discharge of network 64 to the appropriate "1" level at the input to gate 122.

Additionally, a closure of arm switch 98 at any time prior to the tripping or closing of sensor switch 109 will effect the shutdown of the system. This is realized by virtue of the earlier described imposition of a "1" level at the input to gate 102 and consequent "0" level at the output line 108 thereof.

Looking now to oscillator circuit 68, the input thereto at line 132 is shown coupled with output line 124 through a blocking diode 134. The circuit incorporates two inverter gates 135 and 136 coupled for power input from lines 84 and 137, respectively, from lines 138 and 139 and to opposite power line 76, respectively, from lines 140 and 141. The gates 135 and 136 provide the above-noted conventional inverter logic, a high or low value applied at their inputs, respectively, deriving a low or high value at their outputs. However, as described earlier, the gates may exhibit a hysteresis characteristic in this regard. The output at line 146 of gate 136 is connected through line 147, line 148, capacitor 149 and a stabilizing resistor 150 to input line 132. A line 152 connects the output of gate 135 with the input of gate 136 and, in turn, is connected with one end of a line 154 incorporating a timing resistor 156, the other end of line 154 connecting to line 148 between capacitor 149 and resistor 150.

The above catalogued components constitute the higher frequency oscillator of network 68. Having a frequency selected for maximizing human audio recognition, i.e. between 1 and 4 KHz, the higher frequency oscillator is modulated by a second oscillator preferably operating in the 2–5 C.P.S. range. The second, modulating oscillator of network 68 includes gate or trigger 160, the input of which is connected through lines 161, 162, resistor 163 and line 146 through diode 164 to the output of gate 136. Line 146 also extends through a resistor 166 to line 76, while line 162 additionally is coupled through capacitor 168 to line 76. The output of trigger or gate 160 extends at line 170 through a diode 172 to line 132. Gate 160 is powered from line 84 through line 137 and from line 174 to line 76. Of importance, trigger or gate 160 exhibits a hysteresis characteristic wherein its trigger level on a positive going input is not the same as that for a negative going input.

The operation of the higher frequency circuit 68 may be described by initially assuming the output of gate 135 at line 152 to be in a "1" state. This "1" condition, applied to the input of gate 136, evolves a "0" output thereof at line 146 which output is monitored at capacitor 149. However, capacitor 149 will be charged from the "1" value at line 152 through line 154 and resistor 156. The time constant involved provides the designated oscillatory period for the circuit. As capacitor 149 thus is charged to a high level, the input to gate 135 correspondingly becomes high, the output of the gate becomes low and the output of gate 136 at line 146 assumes a "1" value. Capacitor 149 then discharges through resistor 156 within line 154. Discharge again takes place over the designated oscillatory period of the circuit. At the termination of such discharge, the voltage level at the input of gate 135 passes the one trigger level thereof, and its output at line 152 reverts to a high state. As a result, the output of gate 136 at line 146 reverts to a "0" value and the oscillatory cycle is reiterated.

The higher frequency oscillator circuit of network 68 is selectively disabled or enabled by virtue of the signal value at output line 124 operating in conjunction with diode 134. For instance, when the signal value at line 124 is "0", the high input through resistor 150 to gate 135 is diverted to ground through diode 134. As a consequence, no oscillation takes place and a "0" level is present at output line 146 of the oscillatory circuit. Conversely, with the assertion of a "1" value at line 124, indicating an alarm condition, diode 134 is back-biased and the circuit is permitted to oscillate in the fashion described hereinabove, a "1" value readily being asserted at input line 132 through resistor 150.

One output of the higher frequency astable multivibrator or oscillator circuit is present at line 148 and is directed through resistor 176 to the base of transistor $Q_1$ of Darlington connected drive transistors $Q_1$ and $Q_2$. The drive transistors are forwardly biased to provide a conductive path through loudspeaker 70 in the presence of a high value at line 148. This Darlington connection will be observed to provide for the connection of the emitter electrode of transistor $Q_1$ to the base of transistor $Q_2$, while the collector electrode of transistor $Q_1$ is coupled to the collector of transistor $Q_2$ in common with line 74. Additionally, the emitter electrode of transistor $Q_2$ is coupled with line 76 to provide a switching function responsive to the logic condition at line 148. Accordingly, in the presence of a "1" logic level at line 124, network 68 performs an oscillatory function providing alternate high and low values at line 148 in accordance with a frequency predetermined to elicit maximum human audio response. With each high level at line 148, transistors $Q_1$ and $Q_2$ are forwardly biased to effect the conduction of current through speaker 70. Conversely, a low value at line 148 turns off transistors $Q_1$ and $Q_2$ to complete the cycle definition.

With a "1" level at line 124, diode 134 is back-biased to permit the alternate assertion of "0" or "1" levels from line 148 and resistor 150 to the input of gate 135. Modulating gate 160 and diode 172 serve to override the signal at line 132 at a pulsating 2–5 C.P.S. rate. Whenever the output of gate 160 is "0", forward-biased diode 172 directly (i.e. with low impedance) impresses that "0" value at line 132. At such times the higher frequency oscillator components are deactivated. Conversely, in the presence of a "1" value at line 170, diode 172 is back-biased and, assuming diode 134 to be similarly back-biased, the higher frequency oscillator components are permitted to operate.

As discussed above, during its activation, the higher frequency oscillator will provide alternating "1" and "0" values at its output line 146. These outputs, respectively, will forward and back-bias diode 164. Returning to the modulating oscillator, when diode 164 is foreward-biased, an incremental charge is provided at capacitor 168 through line 162 and resistor 163. This charge is substantially held during that portion of a cycle when diode 164 is back-biased. Gradually, i.e. incrementally, the voltage level witnessed at input line 161 reaches the positive going trigger level of gate 160, i.e., about 6.8 volts for a 9 v power supply 72. As this occurs, the output of gate 160 at line 170 transitions from a "1" to a "0" to disable the operation of the higher frequency oscillator components. This "0" level is held for one-half of the modulation cycle, an interval determined by the gradual discharge of capacitor 168 through resistors 163 and 166 to the lower threshold trigger level of gate 160. Recall that, due to the hysteresis characteristic of the gate, this trigger level is not the same as the positive going one, i.e., for a 9 v power supply 72, it will be at about 4.2 v. Thus, an oscillatory operation is achieved even though only a single gate (160) is utilized. As the lower trigger level of gate 160 is derived at line 161, the output thereof transitions to a "1" to back-bias diode 172 and permit operation of the higher frequency oscillatory stage.

Gate 160 may be connected in a free running state which would still result in the same output signal to loudspeaker 20. For this method of operation resistor 163 is connected at one end to the input of gate 160 at line 161 and the other end is connected to the output of gate 160 at line 170. Diode 164 and resistor 166 are not used and therefore can be eliminated. This results in a free running oscillator at the lower frequency modulating the higher frequency oscillator when it is gated on.

The lower frequency oscillator (gate 160) is always operating but due to its very low current drain it will not affect battery life and its affects on the higher frequency oscillator and loudspeaker 70 will only be noticed when an alarm signal, "1" value, is present at the output of gate 122 at line 124.

It may be noted that no on-off switch is provided in the circuit inasmuch as it is not required by virtue of the very low standby current demand of the circuit. For instance, during typical use, the standby requirement is about 5 micro-amps.

Figure 4:
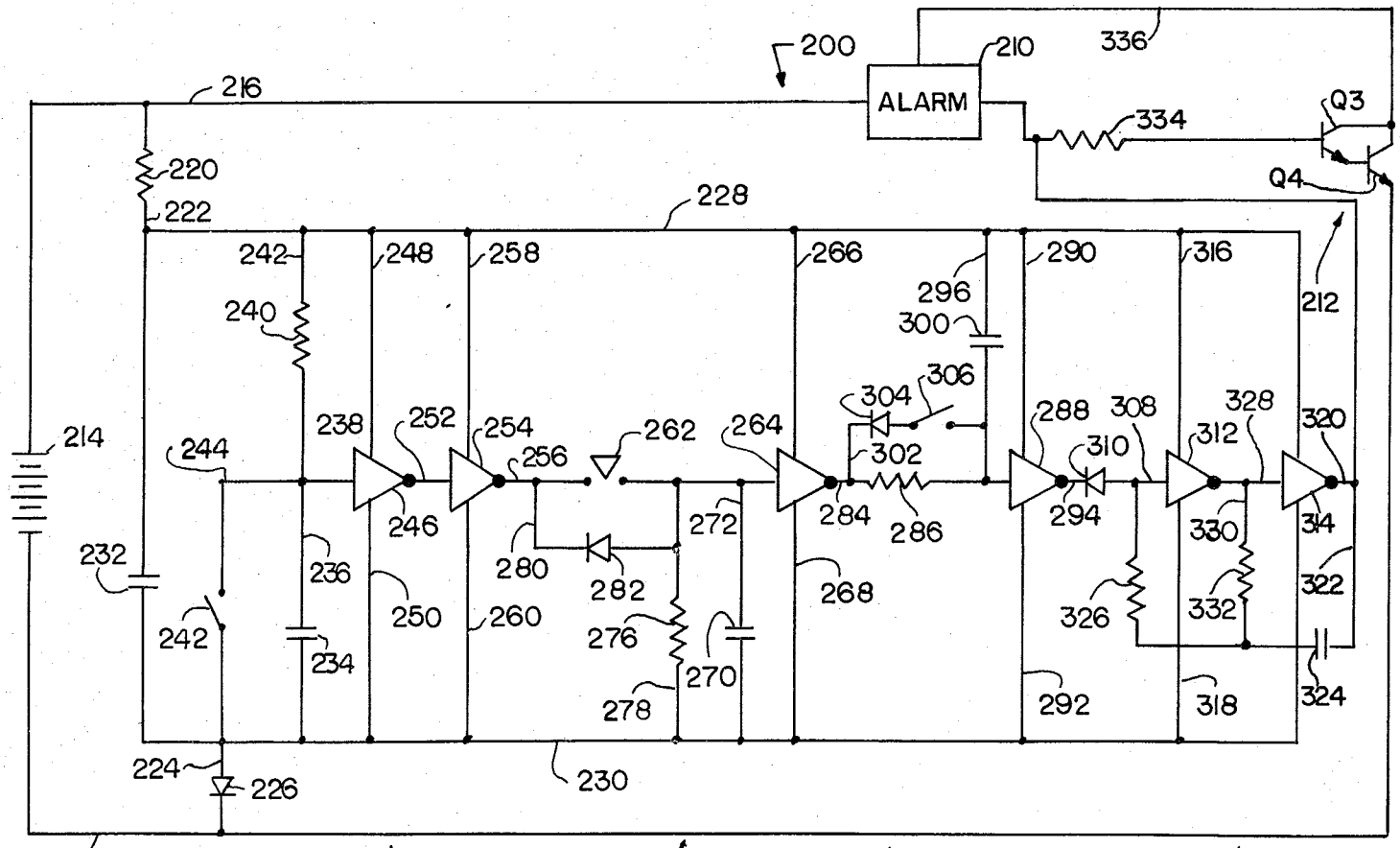
FIG. 4 is a schematic drawing of the logic circuit of another embodiment of the invention.

Turning to FIG. 4, a circuit intended for incorporation within unit 10 and operable in complement with sensor assembly 22 is revealed. This circuit is preferred for embodiments wherein it is desirable to have the audible alarm in the form of an electromechanical buzzer or horn modulated at the lower frequency level noted in the previous discussion. Circuit 200 generally includes a first or initial timing or delay circuit 202; two additional timing networks 204 and 206; and oscillator network 208; a "buzzer" type alarm or the like 210, and a driver arrangement for the latter 212. Inverter gates formed of COS/MOS circuits are utilized in developing the logic to be described, such circuits generally consisting of one p-channel and one n-channel enhancement-type MOS transistor which are combined to provide conventional inverter logic. As noted earlier, such gates exhibit very little power drain when the circuit is in a quiescent state, thereby contributing one facet to the noted high efficiency of the circuit of the system. As in the case of the embodiment of FIG. 3, the terms "high" or "1" and "low" or "0" are utilized in the description to designate operational states.

Power may be supplied to the circuit 200 from a battery 214 which may be of a typically locally available 9 volt variety. The positive terminal of battery 214 is coupled through line 216 to alarm function 210, while the opposite pole thereof is coupled through line 218 to driver arrangement 212. Connection of the logic components of the circuit from line 216 is provided through resistor 220 present within line 222 and from line 218 through line 224 and diode 226. Line 222, in turn is coupled to logic power line 228, while line 224 is connected to logic power line 230. A capacitor 232 is connected intermediate lines 228 and 230 and this capacitor, operating in conjunction with resistor 220 provides a filtered power level input for the logic components at respective lines 228 and 230. This arrangement is particularly useful in functioning to noise isolate the circuit interrupting character of operation of the alarm device 210 where such device is of the above-described variety which interrupts the circuit within line 216 in the course of providing an audibly perceptive alarm. Resistor 220 also serves a current limiting function. Similarly, diode 226 protects the logic components from an inadvertent assertion of a reverse voltage. For consumer related devices, it may be anticipated as a facet of product design that battery 214 may inadvertently be inserted within the device with an improper reversed orientation.

As in the earlier embodiment, circuit 200 incorporates an initial timing or delay circuit 202 which serves the function of permitting the sensor 22 to achieve a null state and also for permitting the user to, for instance, leave through the door upon which the device is mounted. Circuit 202 includes a capacitor 234 positioned within line 236 which, in turn, extends between line 230 and input line 238, as well as a timing resistor 240 positioned within line 241 between line 228 and line 238. The arm switch in the instant embodiment is shown at 242 positioned within line 244 and coupled in shunt relationship across capacitor 234 between lines 238 and 230. Accordingly, with the opening of switch 242, timing circuit 202 is activated to commence a voltage buildup at line 238 toward a "1" level, which signal is introduced to the input of inverter gate 246. Coupled in power supply relationship to lines 228 and 230 through respective lines 248 and 250, gate 246 may be a C-MOS model CD 4049 device marketed by Radio Corporation of America. The gate exhibits a threshold voltage characteristic such that upon the occurrence of a "1" value at its input line 238, the output thereof at line 252 converts from that "1" to a "0" level. Generally, the threshold characteristic of this and the remaining gates within circuit 200 are such that conversion from high to low values selectively occurs at a voltage level of from one-third to two-thirds of the voltage applied thereacross as through lines 248 and 250. The resistance and capacitance values at circuit 202 are such as to effect the conversion at gate 246 following about a thirty-second delay from the opening switch 242. The "0" "arm" signal level at line 252 is, in turn, introduced to the input of an identical inverter gate 254 which inverts such signal to provide a "1" signal level representing an arm condition signal at the output line 256 thereof. Gate 254 is powered from lines 228 and 230, respectively, through lines 258 and 260. Note that prior to the conversion of line 256 to a high value, its normal status is low.

Line 256 incorporates the inertially responsive sensor switch 22 earlier described as including reed switch 44 and now represented as switch 262. From the opposite side of switch 262, line 256 is directed to the input of another inverter gate 264 powered from lines 228 and 230, respectively, from lines 266 and 268. Coupled between lines 256 and 230, intermediate switch 262 and the input to gate 264, is a timing network 206 including capacitor 270 coupled within line 272. Note additionally, the presence of a resistor 276 connected within line 278. A line 280 incorporating diode 282 connects from line 278 across switch 262 to line 256 as it extends from the output of gate 254.

With the arrangement shown, assuming that sensor switch 262 has been actuated to close, the arm condition signal or "1" level is conveyed across switch 262 to the input of gate 264. Assuming that switch 262 is closed only instantaneously, such interval is adequate to rapidly charge capacitor 270 to a high state, the only limitation to the rate of such charge being the low resistance of gate 254 itself. Normally, capacitor 270 will charge in less than a millisecond. The "1" level thus developed at the input to gate 264, representing a conveyed arm condition signal, converts the normal "0" level thereat to a "1" value, to cause, in turn, the conversion of the output of gate 264 at line 284 from a "1" to a "0" value. Note that the "0" value normally retained at the input of gate 264 is held through resistor 276 in line 278.

The output line 284 of gate 264 extends through resistor 286 to the input of gate 288. Inverter gate 288 is connected to lines 228 and 230 respectively through lines 290 and 292 and provides an output at line 294.

Extending intermediate resistor 286 and the input to gate 288 between lines 284 and 228 is a line 296 incorporating a timing capacitor 300. Also formed within timing network 204 is a line 302 extending from the output of gate 264 at line 284 across resistor 286 to line 296. Line 302 incorporates a blocking diode 304 as well as a switch 306. Providing an alarm delay function, switch 306, when closed, serves to effect an instantaneous response of the alarm system to the closure of sensor switch 262. Alternately, when switch 306 is open, the system provides about a ten-second delay between the closure of sensor switch 262 and the sounding of an alarm at alarm device 210.

Looking in more detail at the functions of timing networks 206 and 204 and assuming an arm condition signal at the output of gate 254, a single closure of sensor switch 262 results in timing capacitor 270 charging immediately to a "1" state as was noted previously. In the absence of any additional sensor signals, timing capacitor 270 will proceed to discharge through lines 272, 256, 278 and resistor 276 to again achieve a "0" value after a predetermined amount of time, i.e., about 30 seconds. Any additional sensor closures during that period of time will result in a recharging of capacitor 270 and the "adding on" of 30 seconds more to the presence of a "1" signal at the input to gate 264, that is, assuming that the arm condition signal is still present at the output of gate 254. With the assertion of a conveyed arm condition signal of "1" value at the input to gate 264, the resultant signal value at its output at line 284 is "0". However, prior to the derivation of a "0" value at line 284, that line is at a "1" value, that value being present at the input of gate 288. Additionally, capacitor 300 is discharged at a high level. The corresponding value at output line 294 is a "0" which will be observed to hold oscillator circuit 208 in an inactive condition. Assuming the closure of switch 306, and the presence of a low value at the output line 284 of gate 264, the "1" value at capacitor 300 immediately is dissipated through line 302 to ground through gate 264 and line 268. The resultant instantaneous "0" value at the input to gate 288 is converted to a "1" level at its output line 294 to effect an activation of oscillator circuit 208 and, in consequence, the sounding of an audibly perceptible alarm at device 210.

Thus being charged to achieve a "0" signal level, capacitor 300 then maintains that level until the input of gate 264 reverts to a "0" level as was described previously. The presence of a "0" at the input to gate 264 results in a "1" output at line 284 and at that time capacitor 300 will proceed to discharge through lines 296, 284, 266 and resistor 286 to gradually reassume a "1" level at the input to gate 288. This discharge period will be about equal to the alarm delay period since it incorporates the same components and is selected to be about ten seconds. At the termination of this total interval (the discharging of capacitors 270 and 300), a "1" level is reasserted at the input of inverter gate 288 as at line 284 to convert its output at line 294 to a "0" level. In consequence, the oscillator circuit 208 is deactivated to, in turn, deactivate alarm device 210. As will be noted from the foregoing description, the alarm, after being triggered, will sound for a period of time of at least 40 seconds, (30 seconds from network 206 and 10 seconds from network 204) and will then shut down automatically. This feature is a valuable asset for the condition where a single false signal may be received setting off the alarm with no one present in the home. Since it will shut itself off it will not result in generating extreme aggravation with the "neighbors" or wearing out of the battery when such spurious signals are received. Of course, if additional alarm signals are received, then the alarm will continue to sound for 40 seconds after the last received signal.

Should the operator of the system desire to provide, for instance, a ten-second delay in the activation of alarm device 210 following the tripping or closing of sensor switch 262, switch 306 is set in the open position. Such an arrangement, for example, permits reaccess through the door upon which the unit is mounted and disarming within that ten-second interval, thereby permitting its use without the incorporation of an alarm disabling device mounted externally of the door. With this alarm condition, the above-mentioned 40-second period is reduced by the alarm delay period to 30 seconds for a single spurious alarm signal. Assuming that sensor switch 262 has been closed under the above condition, a conveyed arm condition signal is present at the input of gate 264. The resultant "0" level at its output at line 284 does not effect an immediate charge of capacitor 300 to, in turn, immediately cause the assertion of a "0" signal level at the input to gate 288. Under the noted delay condition, capacitor 300 now is required to charge through resistor 286 and gate 264 through line 268 to ground. The time constant for these components is arranged, for example, to require about ten seconds to provide for the development of a "0" level signal at the input to gate 288. At the termination of such interval, gate 288 inverts the input "0" level signal thereat to a "1" value at its output line 294 to commence activation of the alarm.

Assuming this feature is being used to enter the door upon which the unit is mounted, within the noted ten-second delay interval, the operator closes switch 242 to effect the shunting of capacitor 234, and, in turn, impose a "0" level at input line 238 of gate 246. The output of gate 246 reverts to a "1" level at line 252, which is introduced to gate 254 to effect a "0" signal level at its output at line 256. This "0" level at line 256 causes the immediate discharge of capacitor 270 through lines 272, 256, 280, diode 282, gate 254 and line 260 to ground. A "0" input signal level thereby is presented at the input to gate 264 which is converted to a "1" level at its output at line 284. As a consequence, capacitor 300 is prevented from any further charge to ground and the "1" level is retained at the input to gate 288 to maintain a "0" signal level at its output line 294 and inactivation of oscillator circuit 208. No alarm activation ensues.

Diode 304 serves a particular function under situations with switch 306 closed and wherein switch 242 is closed after an alarm condition has been established with the tripping of switch 262 and the activation of alarm device 210. With the noted closure of switch 242, the output of gate 264 rapidly converts from a "0" to a "1" output level. Capacitor 300 will be at some charge level below a "1" level effecting the continued "1" (alarm) level output of gate 288 at line 294 diode 304 preventing its immediate discharge through switch 306. This alarm condition will continue, capacitor 300 having to be discharged through resistor 286 to effect a coninuance of the alarm signal until such time as a "1" value signal level is achieved at the input to gate 288. This, therefore makes it impossible, once alarm 210 has been activated, to immediately "shut down" the alarm with the closure of switch 242 and guarantees the sounding of alarm 210 for some predetermined minimum interval. It may also be noted that diode 282 serves the function of assuring the appropriate discharge of capacitor 270 upon the closing of switch 242, even though sensor switch 262 may be opened or alternately opened and closed during this deactivation procedure.

Normally, the system will continue to sound an alarm from device 210 following the initial activation thereof until both timing networks 204 and 206 discharge to the appropriate "0" level for network 206 at the input of gate 264 and then serially the discharge of network 204 to the appropriate "1" level at the input to gate 288.

Additionally, a closure of arm switch 242 at any time prior to the tripping or closing of sensor switch 262 will effect the shutdown of the system. This is realized by virtue of the earlier described imposition of a "1" level at the input to gate 254 and consequent "0" level at the output line 256 thereof.

Looking now to oscillator circuit 208, the input thereto at line 308 is shown coupled with output line 294 through a blocking diode 310. The circuit incorporates two inverter gates 312 and 314 coupled for power input from line 228, respectively, from lines 316 and the extension of line 228 and to opposite power line 230, respectively, from line 318 and the extension of line 230. The COS/MOS gates 312 and 314 provide the above-noted conventional inverter logic, a high or low value applied at their inputs, respectively, deriving a low or high value at their outputs. The output at line 320 of gate 314 is connected through line 322, capacitor 324 and a stabilizing resistor 326 to input line 308. A line 328 connects the output of gate 312 with the input of gate 314 and, in turn, is connected with one end of a line 330 incorporating a timing resistor 322, the other end of line 330 connecting to line 322 between capacitor 324 and resistor 326.

The operation of circuit 208 may be described by initially assuming the output of gate 312 at line 328 to be in a "1" state. This "1" condition, applied to the input of gate 314, evolves a "0" output thereof at line 320 which output is recognized at capacitor 324. However, capacitor 324 will be charged from the "1" value at line 328 through line 330 and resistor 332. The time constant involved provides the designated oscillatory period for the circuit. As capacacitor 324 thus is charged to a high level, the input to gate 312 correspondingly becomes high, the output of the gate becomes low and the output of gate 314 at line 320 assumes a "1" value. Capacitor 324 then discharges through resistor 332 within line 330. Discharge again takes place over the designated oscillatory period of the circuit. At the termination of such discharge, the voltage level at the input of gate 312 passes the transfer-voltage point thereof, and its output at line 328 reverts to a high state. As a result, the output of gate 314 at line 320 reverts to a "0" value and the oscillatory cycle is reiterated.

Circuit 208, however, is selectively disabled or enabled by virtue of the signal value at output line 294 operating in conjunction with diode 310. For instance, when the signal value at line 294 is "0", the high input through resistor 326 to gate 312 is diverted to ground through diode 310. As a consequence, no oscillation takes place and a "0" level is present at output line 320 of the oscillatory circuit. Conversely, with the assertion of a "1" value at line 294, indicating an alarm condition, diode 310 is back-biased and circuit 208 is permitted to oscillate in the fashion described hereinabove, a "1" value readily being asserted at input line 308 through resistor 326.

The output of astable multivibrator or oscillator circuit 208 is present at line 320 and is directed through resistor 334 to the base of transistor $Q_3$ of Darlington connected drive transistors $Q_3$ and $Q_4$. The drive transistors are forwardly-biased to provide a conductive path through alarm device 210 in the presence of a high value at line 320. The Darlington connection will be observed to provide for the connection of the emitter electrode of transistor $Q_3$ to the base of transistor $Q_4$, while the collector electrode of transistor $Q_3$ is coupled to the collector of transistor $Q_4$ in common with line 336. Additionally, the emitter electrode of transistor $Q_4$ is coupled with line 218 to provide a switching function responsive to the logic condition at line 320. Accordingly, in the presence of a "1" logic level at line 294, circuit 208 performs an oscillatory function providing alternate high and low values at line 320 in accordance with a frequency predetermined to elicit maximum human audio response. For instance, a 300 millisecond alternate on-off condition at line 320 is considered appropriate. With each high level at line 320, transistors $Q_3$ and $Q_4$ are forwardly-biased to effect the conduction of current through device 210. Conversely, a low value at line 320 turns off transistors $Q_3$ and $Q_4$ to complete the cycle definition. Device 210 may be of a conventional "buzzer" type wherein a component is inductively driven to open and close a circuit and, in turn, driven an audio noise device at a frequency selected to maximize human audio response. Such alarm devices as at 210 are readily available in the market place.

As before, it may be noted that no on-off switch is provided in the circuit inasmuch as it is not required by virtue of the very low standby current demand of the circuit. For instance, during typical use, the standby requirement is about 5 micro-amps.

Since certain changes may be made in the abovedescribed apparatus and system without departing from the scope of the invention herein involved, it is intended that all matter contained in the above description or shown in the accompanying drawings shall be interpreted as illustrative and not in a limiting sense.

What is claimed is:

1. An alarm system comprising:

alarm means actuable from a power supply to provide a perceptible alarm;

arm switch means actuable from a first to a second orientation to enable said system;

timing circuit means responsive to said arm switch means actuation to said second orientation for deriving an arm condition signal at the termination of a predetermined initial delay interval, said interval commencing with said actuation;

sensor means electrically coupled with said timing circuit means, actuable in response to a sensed externally generated phenomena, for deriving a short, transient conveyance of said arm condition signal;

first control circuit means, electrically coupled with said sensor means and responsive to a said conveyance of said arm condition signal to derive a predetermined input condition for a first predetermined interval;

second control circuit means including alarm delay switch means selectively actuable between instant response and delayed response orientations and responsive to said predetermined input condition when said alarm delay switch means is in said delayed response orientation for effecting the commencement of an output signal following a second predetermined interval from the receipt of said predetermined input condition, and responsive to said predetermined input condition when said alarm delay switch means is in said instant response orientation for substantially immediately effecting the commencement of said output signal;

oscillator means responsive to said output signal for deriving an oscillating output signal of predetermined frequency; and means responsive to said oscillating output signal for actuating said alarm means at said predetermined frequency.

2. The alarm system of claim 1 wherein said second control circuit means is configured to effect the derivation of said output signal substantially for said second predetermined interval following the termination of said predetermined input condition when said alarm delay switch means is in said instant response orientation.

3. The alarm system of claim 1 in which said timing circuit means comprises inverter gate means and an R-C timing network coupled with the input of said inverter gate means, said arm condition signal being derived at the output of said inverter gate means;

said first control circuit means includes a timing network including a capacitor stage; and including circuit means connected between said capacitor stage and said inverter gate means output for dissipating said predetermined input condition in response to the actuation of said arm switch means from said second to said first orientation.

4. An alarm system comprising:

alarm means drivable from a power supply to provide a perceptible alarm;

arm switch means actuable from a first to a second orientation to enable said system;

timing circuit means responsive to said arm switch means actuation to said second orientation for deriving an arm condition signal at the termination of a predetermined initial delay interval, said interval commencing with said actuation;

sensor means electrically coupled with said timing circuit means and actuable in response to a sensed externally generated phenomena for deriving a short, transient conveyance of said arm condition signal;

control network means including control circuit means electrically coupled with said sensor means and responsive to said conveyance of said arm condition signal to derive a predetermined input condition from which said control network means derives an output signal for a predetermined interval of time;

oscillator network means coupled with said control network means, having an input and an output and deriving an oscillating output signal at a first frequency at said output only in the presence of said control means output signal at said input;

means responsive to said oscillating output signal for driving said alarm means at said first frequency;

modulator network means coupled with said oscillator network input and output and comprising an R-C timing network coupled with said oscillator network means output, and trigger means exhibiting a hysteresis triggering characteristic and having an output coupled with said oscillator network means input and an input coupled with said R-C timing network, for periodically diverting said control network means output signal from said input at a second frequency lower than said first frequency to effect a corresponding periodic driving of said alarm means.

5. The alarm system of claim 4 in which said control network means further includes second control circuit means including alarm delay switch means selectively actuable between instant response and delayed response orientations and responsive to said predetermined input condition when said alarm delay switch means is in said delayed response orientation for effecting the commencement of said output signal following a second predetermined interval from the reciept of said predetermined input condition, and responsive to said predetermined input condition when said alarm delay switch means is in said instant response orientation for substantially immediately effecting the commencement of said output signal.

6. The alarm system of claim 4 wherein said second control circuit means is configured to effect the derivation of said output signal substantially for said second predetermined interval following the termination of said predetermined input condition when said alarm delay switch means is in said instant response orientation.

7. The alarm system of claim 4 in which said timing circuit means comprises inverter gate means and an R-C timing network coupled with the input of said inverter gate means, said arm condition signal being derived at the output of said inverter gate means;

said control circuit means includes a timing network including a capacitor stage; and including circuit means connected between said capacitor stage and said inverter gate means output for dissipating said predetermined input condition in response to the actuation of said arm switch means from said second to said first orientation.

8. The alarm system of claim 4 wherein said control network means further includes second control circuit means including alarm delay switch means selectively actuable between instant response and delayed response orientations and responsive to said predetermined input condition when said alarm delay switch means is in said delayed response orientation for effecting the commencement of an output signal following a second predetermined interval from the receipt of said predetermined input condition, and responsive to said predetermined input condition when said alarm delay switch means is in said instant response orientation for substantially immediately effecting the commencement of said output signal.

9. The alarm system of claim 7 wherein:

said control network means includes second control circuit means including alarm delay switch means selectively actuable between instant response and delayed resonse orientations and responsive to said predetermined input condition when said alarm delay means is in said delayed response orientation for effecting the commencement of an output signal following a second predetermined interval from the receipt of said predetermined input condition, and responsive to said predetermined input condition when said alarm delay switch means is in said instant resonse orientation for substantially immediately effecting the commencement of said output signal; and wherein said second control circuit means is configured to effect the derivation of said output signal substantially for said second predetermined interval following the termination of said predetermined input condition when said alarm delay switch means is in said instant response orientation.

* * * * *